US007578500B2

(12) United States Patent
Tsuchida

(10) Patent No.: US 7,578,500 B2
(45) Date of Patent: Aug. 25, 2009

(54) SHEET FEEDING APPARATUS AND IMAGE FORMING APPARATUS

(75) Inventor: Takeshi Tsuchida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 224 days.

(21) Appl. No.: 11/688,330

(22) Filed: Mar. 20, 2007

(65) Prior Publication Data

US 2007/0222140 A1 Sep. 27, 2007

(30) Foreign Application Priority Data

Mar. 27, 2006 (JP) ..... 2006-085120

(51) Int. Cl.
*B65H 1/00* (2006.01)

(52) U.S. Cl. ..... 271/171; 271/9.05; 271/9.09; 399/389

(58) Field of Classification Search ..... 271/171, 271/4.02, 9.05, 9.09; 399/389, 392; 400/633
See application file for complete search history.

(56) References Cited

U.S. PATENT DOCUMENTS

| | | | | |
|---|---|---|---|---|
| 4,511,904 | A | 4/1985 | Takahashi | |
| 4,849,796 | A * | 7/1989 | Murakami | 399/21 |
| 5,521,684 | A * | 5/1996 | Takahashi | 399/64 |
| 5,927,702 | A * | 7/1999 | Ishii et al. | 271/9.09 |
| 6,164,639 | A * | 12/2000 | Toh et al. | 271/171 |
| 6,499,732 | B1 * | 12/2002 | Akaba | 271/9.09 |
| 6,648,327 | B1 * | 11/2003 | Lin | 271/265.02 |
| 6,668,144 | B2 * | 12/2003 | Maruyama | 399/45 |
| 7,130,573 | B2 | 10/2006 | Nakamori et al. | |
| 7,383,015 | B2 * | 6/2008 | Sato | 399/392 |
| 7,457,579 | B2 * | 11/2008 | Morimoto | 399/370 |
| 2003/0194252 | A1 * | 10/2003 | Nakamori | 399/389 |
| 2004/0178563 | A1 | 9/2004 | Tsuchida | 271/126 |
| 2005/0078973 | A1 * | 4/2005 | Suzuki | 399/45 |
| 2006/0255531 | A1 * | 11/2006 | Azzopardi et al. | 271/171 |
| 2007/0057429 | A1 * | 3/2007 | Watanabe et al. | 271/9.01 |

FOREIGN PATENT DOCUMENTS

| | | | |
|---|---|---|---|
| CN | 1452031 | | 10/2003 |
| JP | 61174035 | A * | 8/1986 |
| JP | 05178469 | A * | 7/1993 |
| JP | 10-39556 | | 2/1998 |
| JP | 2000-98813 | | 4/2000 |
| JP | 2000-098813 | | 4/2000 |
| JP | 2002-139963 | | 5/2002 |
| KR | 1999-49391 | | 7/1999 |

* cited by examiner

*Primary Examiner*—Patrick H Mackey
*Assistant Examiner*—Jeremy Severson
(74) *Attorney, Agent, or Firm*—Fitzpatrick, Cella, Harper & Scinto

(57) ABSTRACT

A sheet feeding apparatus has: a tray on which sheets to be fed are stacked; a sheet feeding portion which separates and feeds the sheets stacked on the tray one by one; and a sensor which discriminates a type of sheet. In a state in which one sheet of the sheets stacked on the tray is protruded from the tray by the sheet feeding portion, the sensor discriminates the type of the protruded sheet.

13 Claims, 8 Drawing Sheets

SHEET FEEDING APPARATUS AND IMAGE FORMING APPARATUS

BACKGROUND OF THE INVENTION

1. Field of the Invention

The present invention relates to a sheet feeding apparatus for separating and feeding stacked sheets one by one and to an image forming apparatus such as copying apparatus or printer using the sheet feeding apparatus.

2. Description of the Related Art

An image forming apparatus such as copying apparatus or printer separates and feeds stacked sheets one by one and forms an image. However, in such an image forming apparatus, the operation is limited depending on a type of sheet which is fed. For example, in the case of a transparent sheet such as an OHP sheet, duplex printing cannot be performed. If the user erroneously selected the duplex printing, generally, the image forming apparatus stops the operation or controls so as to automatically perform simplex printing.

For this purpose, it is necessary to detect the sheet type. As a method of detecting the sheet type, for example, there is a method whereby a reflecting type sensor is used, the sheet type is detected by reflectance of the sheet, and the image forming apparatus is controlled based on a detection result (refer to Japanese Patent Application Laid-Open No. 2000-098813).

However, in the case of a construction using the reflecting type sensor as disclosed in Japanese Patent Application Laid-Open No. 2000-098813, there is a case where the reflectance changes due to a fluttering of the sheet at a position near the detecting position and the sheet cannot be accurately identified. There are many types of sheets such as, particularly, sheet whose surface has a glossiness like an OHP sheet, sheet whose surface has been coated with a film because of a reason for improvement of print quality or the like, and the like. There is, consequently, a case where even the OHP sheet is detected as a normal sheet.

Further, there occurs a case where a foreign substance or the like is deposited onto the sensor surface due to the passage of the sheet and an accurate output is derived.

A construction in which a reflecting type sensor is attached to a side regulating plate and a type of stacked sheet bundle is detected by the sensor has been disclosed in Japanese Patent Application Laid-Open No. 2002-139963. The sensor disclosed in Japanese Patent Application Laid-Open No. 2002-139963 is a reflecting type optical sensor having a light emitting element (not shown) for emitting light and a photosensing device (not shown) for receiving reflection light of the light emitted from the light emitting element. The reflection light from a top one of the papers stacked on a feeding tray is received by the photosensing device. The type of the paper is discriminated based on an output of the received light.

In the construction disclosed in Japanese Patent Application Laid-Open No. 2002-139963, when the top one of the papers stacked on the feeding tray that is the detection object is transparence, the light is irradiated onto a paper other than the top one of the papers stacked on the feeding tray. The photosensing device detects the reflected light from the paper other than the top one of the papers. Therefore a wrong detection might be done. In addition if a sensor discriminates the type of the paper after the paper is fed from the feeding tray, a certain discrimination might be not made because the position of the paper is not suitable for the sensor.

SUMMARY OF THE INVENTION

The invention is made in consideration of the above problems and it is an object of the invention to provide a sheet feeding apparatus which can certainly detect a sheet type and an image forming apparatus using the sheet feeding apparatus.

To solve the above problems, according to the invention, there is provided a sheet feeding apparatus comprising: a tray on which sheets to be fed are stacked; a sheet feeding portion which separates and feeds the sheets stacked on the tray one by one; and a sensor which discriminates a type of sheet fed by the sheet feeding portion, wherein in a state in which one sheet of the sheets stacked on the tray is protruded from the tray by the sheet feeding portion, the sensor discriminates the type of the protruded sheet.

Further features of the present invention will become apparent from the following description of exemplary embodiments with reference to the attached drawings.

DESCRIPTION OF THE EMBODIMENTS

Figure 1:
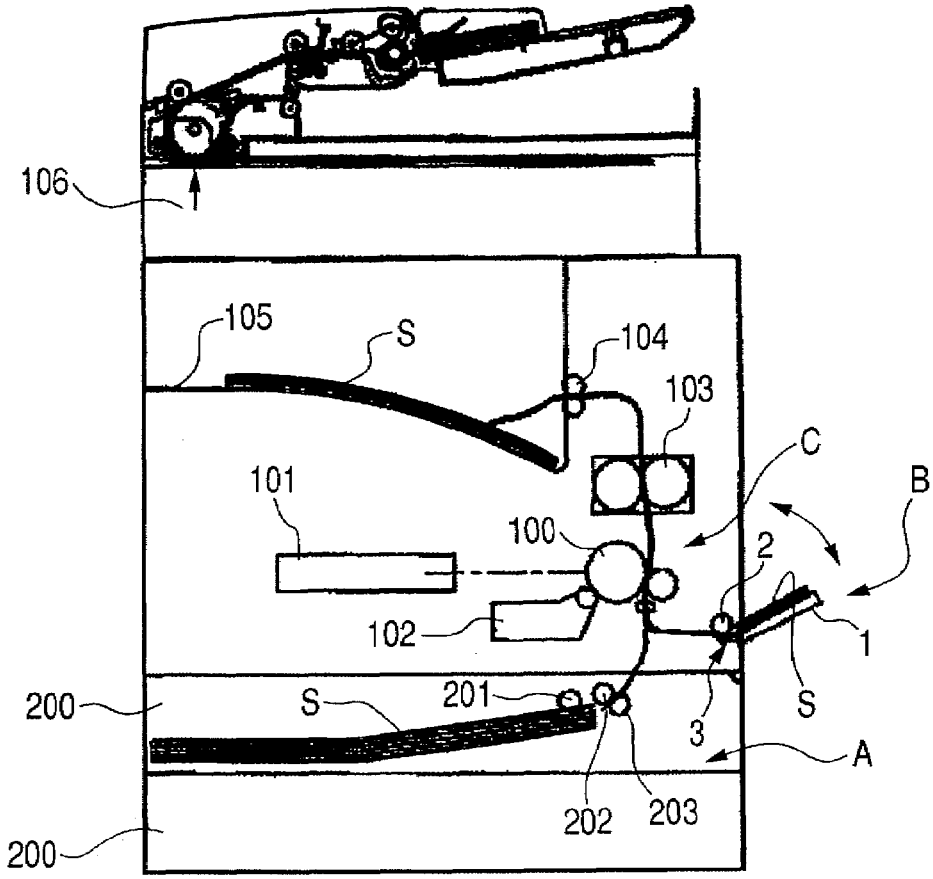
FIG. 1 is a cross sectional explanatory diagram illustrating a whole image forming apparatus.

An image forming apparatus using a sheet feeding apparatus according to an embodiment of the invention will now be described with reference to the drawings.

{Whole Construction of Image Forming Apparatus}

First, a whole construction of the image forming apparatus will be briefly described with reference to FIG. 1. A sheet feeding apparatus A of a cassette type and a sheet feeding apparatus B of a manual inserting type are arranged in a lower portion of the apparatus main body. In an image forming portion C, an image is formed onto a sheet which is fed from one of the sheet feeding apparatuses. The image forming portion of the embodiment uses an electrophotographic system. That is, a latent image is formed by selectively exposing onto a rotating photosensitive drum 100 from an optical scanner 101. The latent image is developed with toner by a developing unit 102 and visualized. The toner image is transferred onto the fed sheet, thereby recording the image. Further, the sheet is conveyed to a fixing unit 103 and the toner image is fixed with a heat. Thereafter, the sheet is discharged to a discharge portion 105 by a discharge roller pair 104.

An original reading apparatus 106 is arranged over the apparatus main body. The original reading apparatus 106 optically reads information of an original document and converts the information into a digital signal. The optical scanner 101 selectively exposes based on the digital signal.

{Sheet Feeding Apparatus}

As illustrated in FIG. 1, according to the sheet feeding apparatus A of the cassette type, sheets S have been stacked on a sheet cassette 200 which is detachable for the apparatus main body, and the sheets S are fed to a separating portion by a pickup roller 201. The separating portion is constructed by: a feed roller 202 which rotates in such a direction as to feed the sheet; and a retard roller 203 which rotates in such a direction as to return the sheet. Thus, the sheets are separated and fed one by one.

According to the sheet feeding apparatus B of the manual inserting type, a tray 1 as a sheet setting portion is rotatably provided for the apparatus main body. The tray 1 is opened as illustrated in FIG. 1 and the sheets S are stacked thereon. The sheets are fed to the image forming portion C by a feed roller 2. The feed roller 2 faces a separating pad 3. The fed sheets S are separated one by one by a frictional force of the separating pad 3 and fed by the feed roller 2. In the embodiment, a sheet feeding portion is constructed by the feed roller 2 and the separating pad 3.

(Sheet Detecting Construction)

A sheet detecting sensor 5 to detect a type of sheet which is fed is provided for the sheet feeding apparatus B of the manual inserting type of the embodiment. A detecting construction of the sheet type will now be described.

Figure 2:
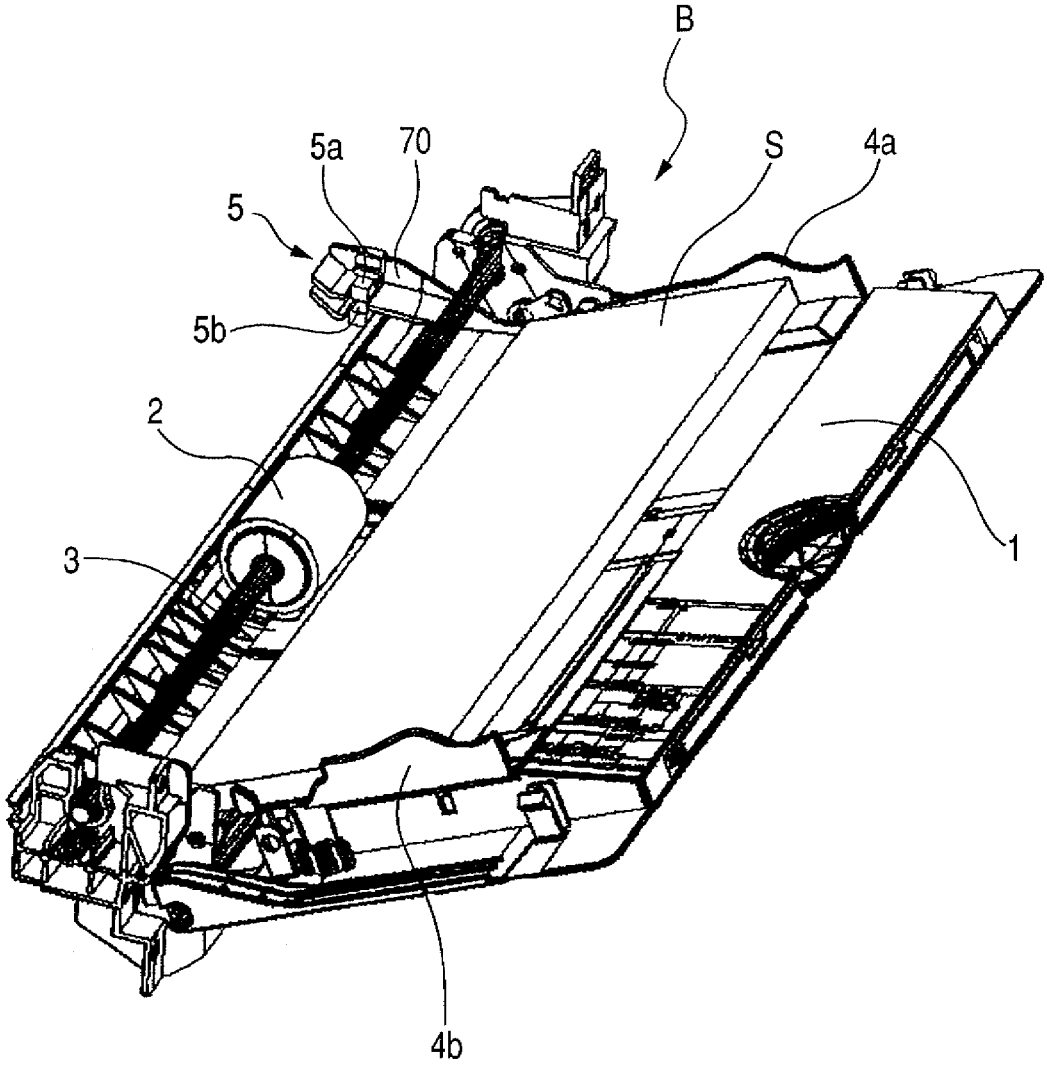
FIG. 2 is a perspective explanatory diagram of a sheet feeding apparatus.

FIG. 2 is a perspective explanatory diagram of the manual inserting sheet feeding apparatus. A bundle of sheets S are stacked onto the tray 1. Side regulating members 4*a* and 4*b* are in contact with both side edge portions in the width direction (direction which perpendicularly crosses a sheet feeding direction) of the sheet S. The side regulating members 4*a* and 4*b* guide the fed sheet so that it does not move obliquely and are movable in the sheet width direction according to a sheet width.

The sheet detecting sensor 5 to detect the sheet type is provided for one of the side regulating members (in this case, 4*a*) between the side regulating members 4*a* and 4*b*. An extending portion 70 which extends to a downstream side of the sheet feeding portion is formed to the side regulating member 4*a*. The sheet detecting sensor 5 is provided for the extending portion 70. The sheet detecting sensor 5 in the embodiment is arranged on the sheet feeding direction downstream side of the contact portion between the feed roller 2 and the separating pad. The sheet detecting sensor 5 is a transmissive photosensor arranged in such a manner that a light emitting portion 5*a* for emitting light and a photosensing portion 5*b* for receiving the light emitted from the light emitting portion 5*a* face in the vertical direction.

In the state in which a part of one sheet of the sheets stacked on the tray 1 is protruded from the tray 1 by the feed roller 2, the sheet detecting sensor 5 discriminates the type of the sheet protruded. At this time, the other part of the protruded sheet is still on the tray 1. The feed roller 2 protrudes a part of one sheet of sheets stacked on the tray 1 from the tray 1. When the protruded part of the sheet passes between the light emitting portion 5*a* and the photosensing portion 5*b*, if the sheet is an OHP sheet, the light transmits and if the sheet is an opaque sheet, the light is shut off. Among the light transmitting sheets, there are a sheet such as an OHP sheet whose light transmittance is equal to, for example, about 80% and through which the light can easily transmit and a sheet such as tracing paper whose light transmittance is equal to a low value within a range, for example, from 30 to 50%. Therefore, by detecting a difference between the amounts of light which passed through the sheets and received by the photosensing portion 5*b*, the sheet type can be discriminated. When showing a specific example as a reference, in the case of general paper, a light transmittance is equal to about 10% and in the case of thick paper, a light transmittance is equal to about 2 to 3%. That is, the sheet detecting sensor 5 in the embodiment detects whether or not the sheet type indicates the OHP sheet by the light transmittance. Further, the sheet detecting sensor 5 in the embodiment detects whether the sheet is thick paper or thin paper by the light transmittance.

Figure 3:
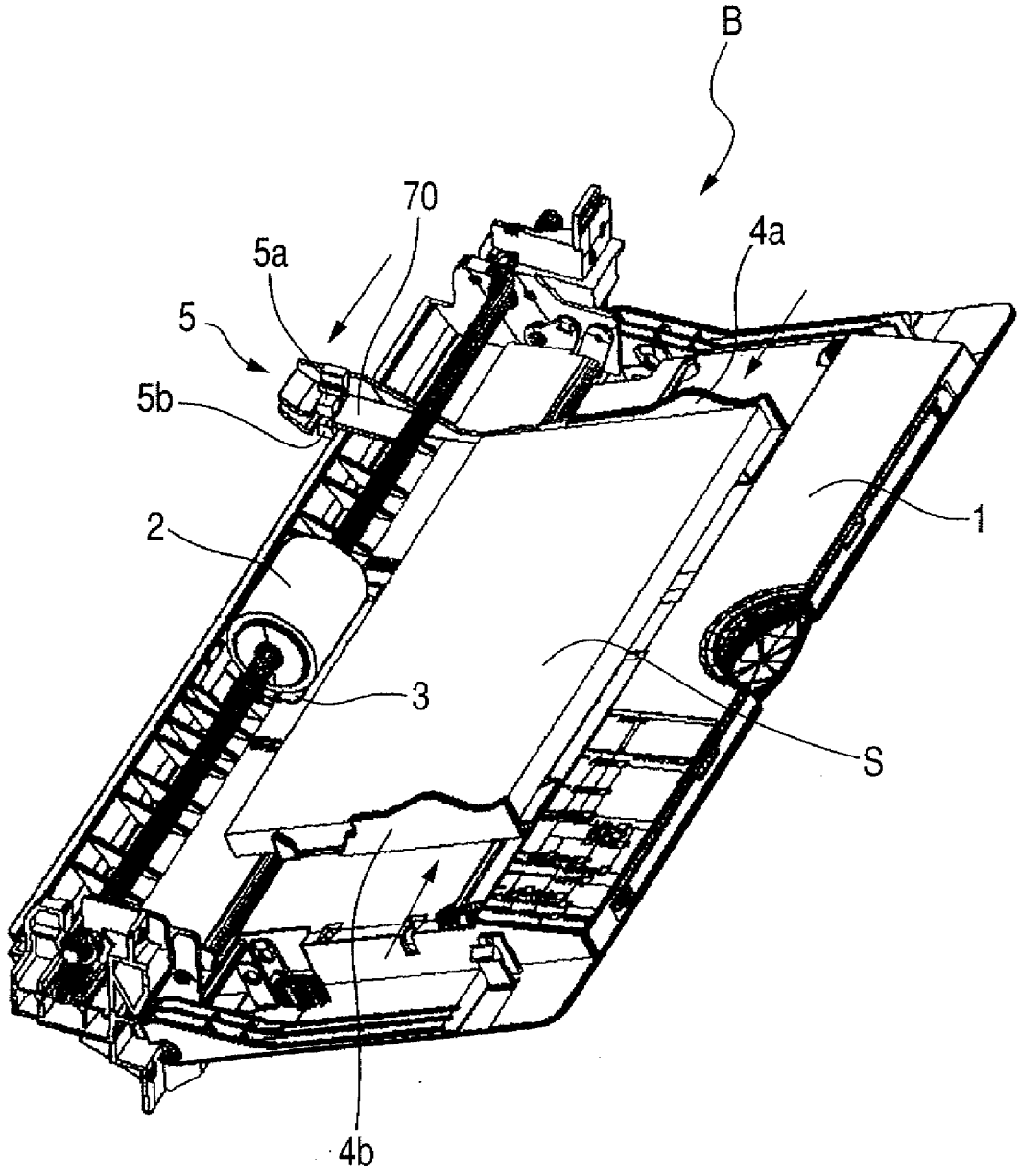
FIG. 3 is a perspective explanatory diagram of the sheet feeding apparatus in the case where a side regulating member has been moved.

FIG. 3 is an explanatory diagram of the sheet feeding apparatus in which the sheets S whose size is smaller than that in the case of FIG. 2 have been stacked. The sheet detecting sensor 5 attached to the extending portion 70 of the side regulating member 4*a* moves integratedly with the movement of the side regulating member 4*a*. Therefore, irrespective of the sheet size, an edge portion of the sheet which is fed passes through the sheet detecting sensor 5 and the sheet type can be certainly detected.

The sheet detecting sensor is a sensor in which the light emitting portion 5*a* and the photosensing portion 5*b* are integrated. The sheet detecting sensor 5 has a coupling portion 5*c* (refer to FIG. 5) which couples the light emitting portion 5*a* and the photosensing portion 5*b*. By using the transmissive photosensor in which the light emitting portion 5*a* and the photosensing portion 5*b* are integrated, the sheet type can be detected by the edge portion of the sheet. Therefore, the sheet detecting sensor 5 can be attached to the side regulating member 4*a*. Each time the sheet size is changed, a vibration is applied to the sheet detecting sensor 5 in association with the movement of the side regulating member 4*a*. Therefore, even if a foreign substance such as paper powder or the like was adhered onto the sensor surfaces (the surface onto which the light emitting portion 5*a* emits the light and the surface on which the photosensing portion 5*b* receives the light), since the foreign substance is dropped out by the vibration, a troublesomeness such as cleaning or the like is also reduced.

Since the transmissive photosensor is used as a sheet detecting sensor 5, for example, an influence of an output fluctuation that is caused due to the fluttering of the sheet is smaller than that of the reflecting type sensor and the erroneous detection of the sheet type can be prevented.

Further, since the sheet detecting sensor 5 is arranged on the downstream side in the sheet feeding direction of the sheet feeding portion, when the sheet type is detected, the separating operation has been finished and the fluttering of the sheet has already been settled. Therefore, a stable output can be obtained in the sheet detecting portion and the erroneous detection can be prevented. With respect to each of the sheets which have been separated and fed one by one by the sheet feeding portion, the sheet detecting sensor 5 detects the sheet type. Thus, even if the sheets S are set onto the tray 1 in the state where different types of sheets are mixed, the sheet type is hardly erroneously detected.

Figure 4:
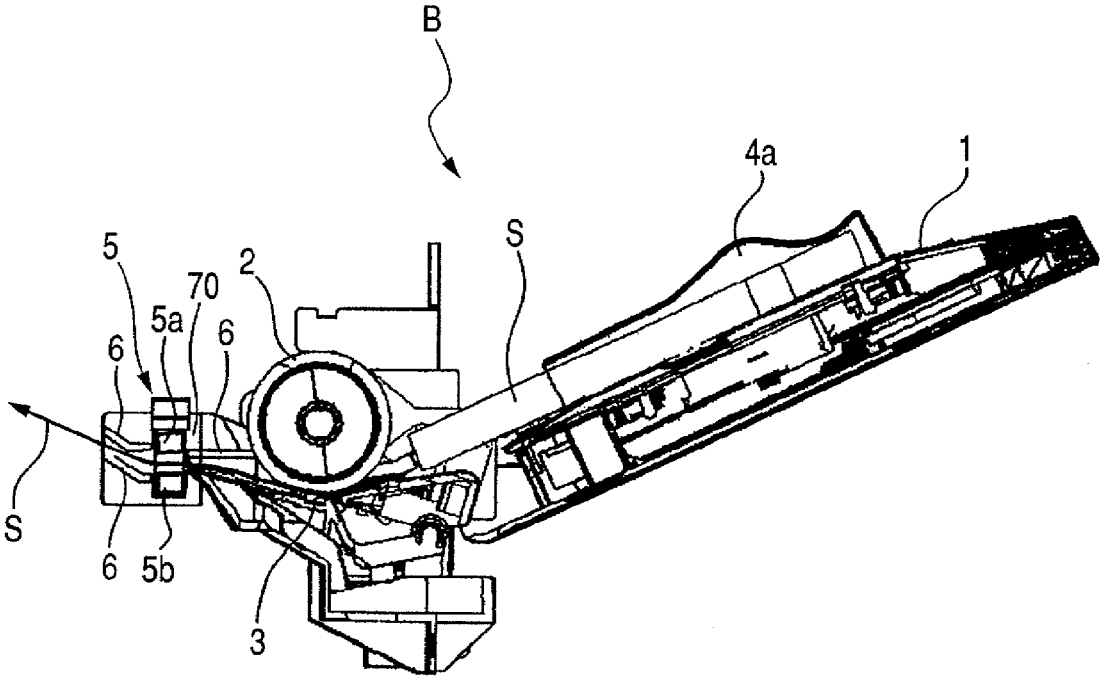
FIG. 4 is a cross sectional explanatory diagram of the sheet feeding apparatus.
Figure 5:
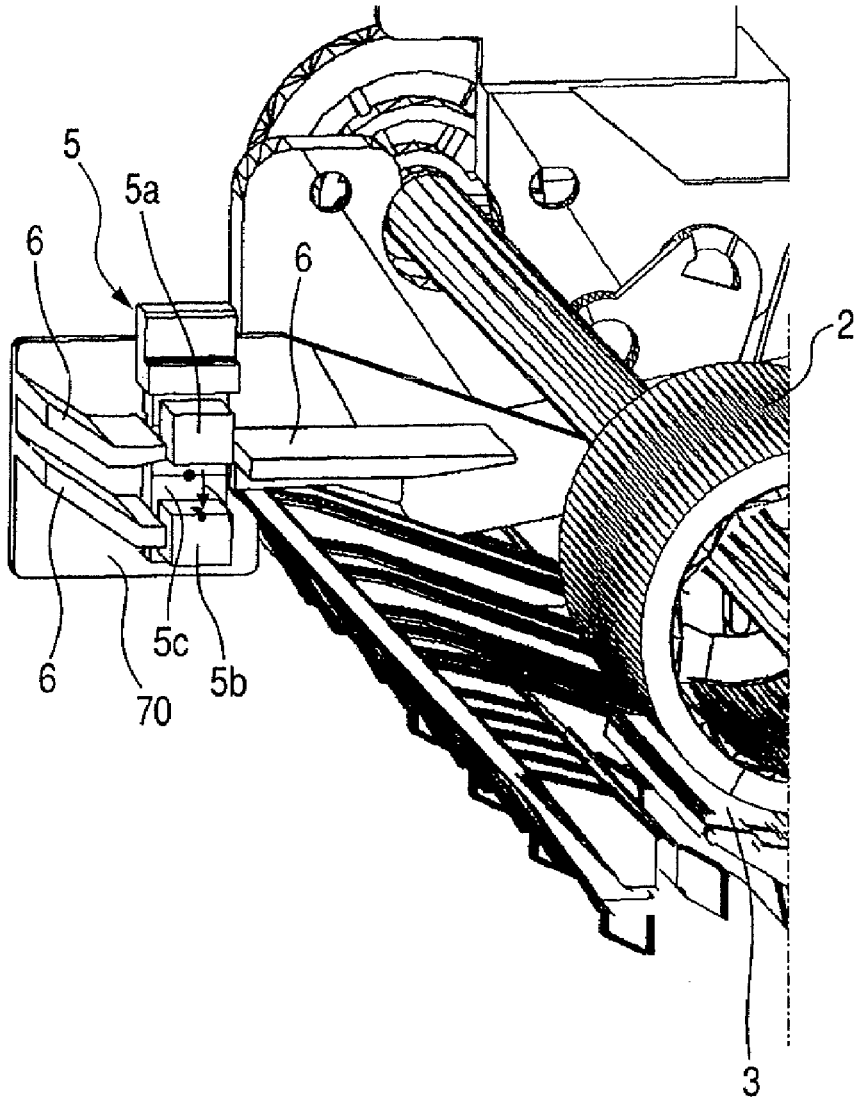
FIG. 5 is a constructional explanatory diagram of a sheet detecting sensor.
Figure 6:
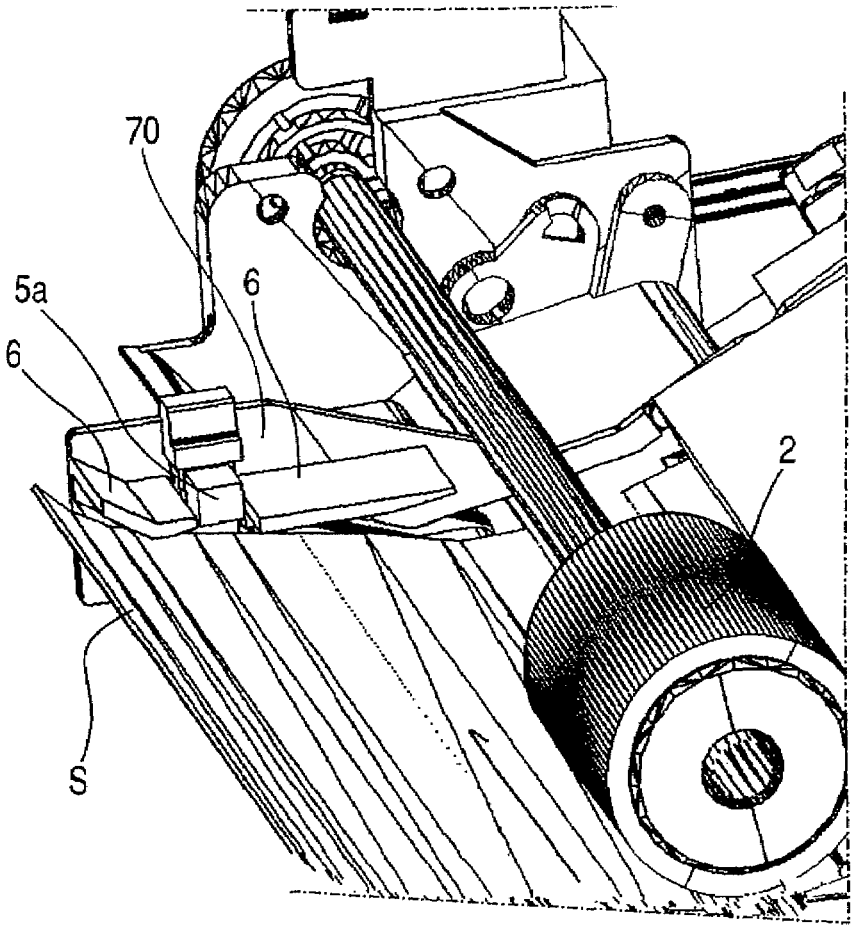
FIG. 6 is a constructional explanatory diagram of the sheet detecting sensor.

As illustrated in FIGS. 4 to 6, guiding portions 6 for guiding the sheet which is fed are formed in the extending portion 70 on the upstream and downstream sides in the sheet feeding direction of the sheet detecting sensor 5. The guiding portions 6 guide the edge portions of the sheet fed by the feed roller 2 to a position between the light emitting portion 5*a* and the photosensing portion 5*b*. The guiding portions 6 also guide the sheet which passed through the sheet detecting sensor (between the light emitting portion 5*a* and the photosensing portion 5*b*) 5 to the image forming portion. The light emitting portion 5*a* and the photosensing portion 5*b* formed as a sheet detecting sensor 5 unit construct a part of the guiding portion which guides the sheet which is fed.

Consequently, as illustrated in FIG. 6, the motion of the sheet which passes through the sheet detecting sensor 5 is stabilized and the detecting precision of the sheet type is also stabilized. By constructing the sheet detecting sensor 5 as a part of the sheet guides, the light emitting portion 5*a* and the photosensing portion 5*b* can be made to further approach the sheet. The sheet type can be detected at higher precision.

In the construction of the embodiment, by detecting the sheet type at the edge portions in the sheet width direction, the sheet type can be detected by the sensor in which the photosensing portion and the light emitting portion are integrated. Further, even in the case where since the side regulating members move, the vibration is applied to the sheet detecting sensor and the sensor surfaces are covered with the foreign substance, the foreign substance is dropped by the vibration. Therefore, there is also such an effect that a troublesomeness such as cleaning or the like is reduced.

Figure 7:
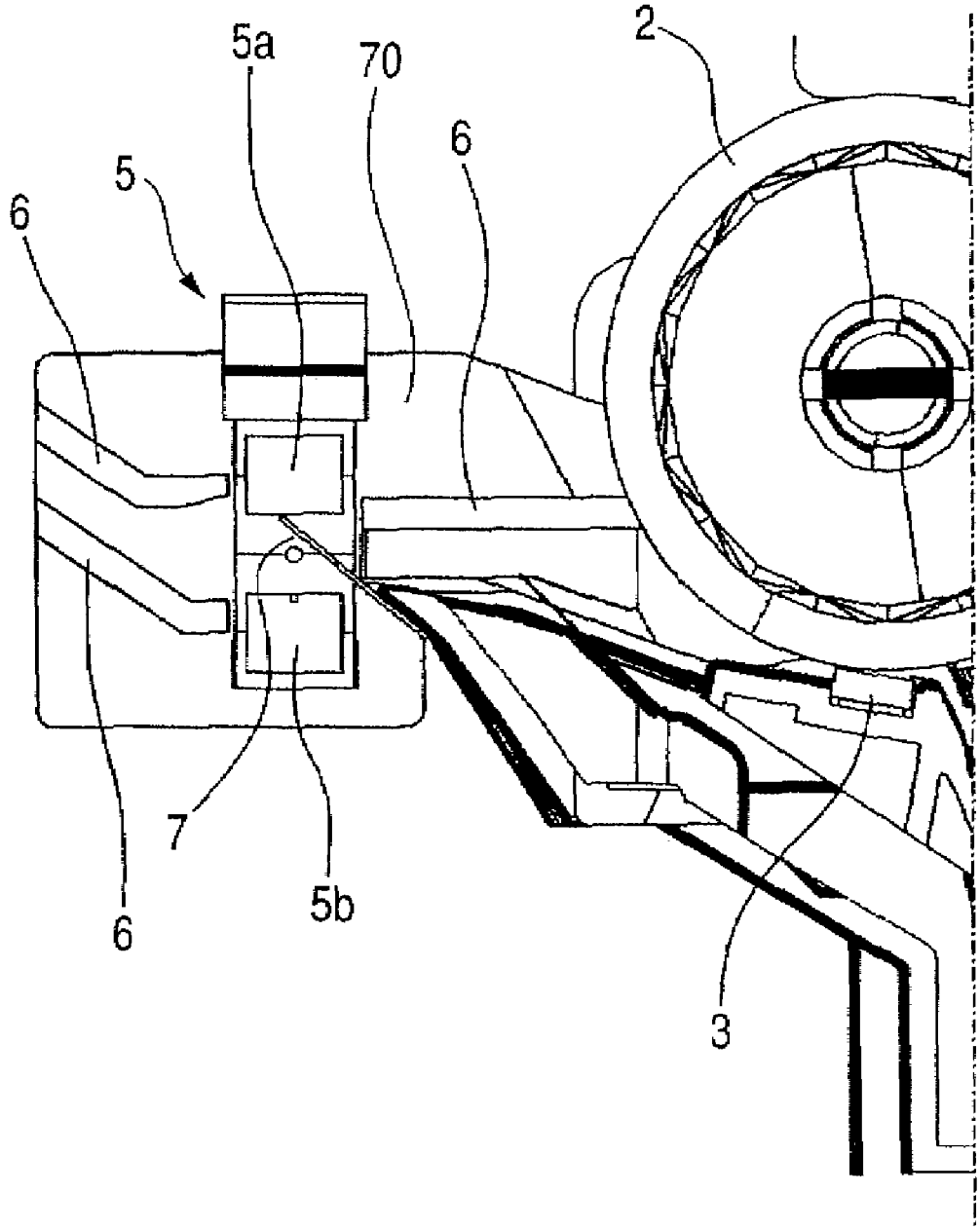
FIG. 7 is a constructional explanatory diagram of the sheet detecting sensor having a dust proofing member.

A dust proofing member for preventing a foreign substance such as paper powder or the like from being deposited onto the sensor surfaces of the sheet detecting sensor 5 may be provided. For example, as illustrated in FIG. 7, a sheet member 7 is provided so as to cover the upper surface of the photosensing portion 5*b* whose sensor surface faces upward between the light emitting portion 5*a* and the photosensing portion 5*b*. The sheet member 7 is made of a transparent flexible sheet. One edge portion of the sheet member 7 is adhered to the edge portion of the tray 1 and the other edge side is extended between the light emitting portion 5*a* and the photosensing portion 5*b*. In the example of FIG. 7, a transparent polyester sheet having a thickness of about 0.3 mm is used as a sheet member 7.

Figure 8:
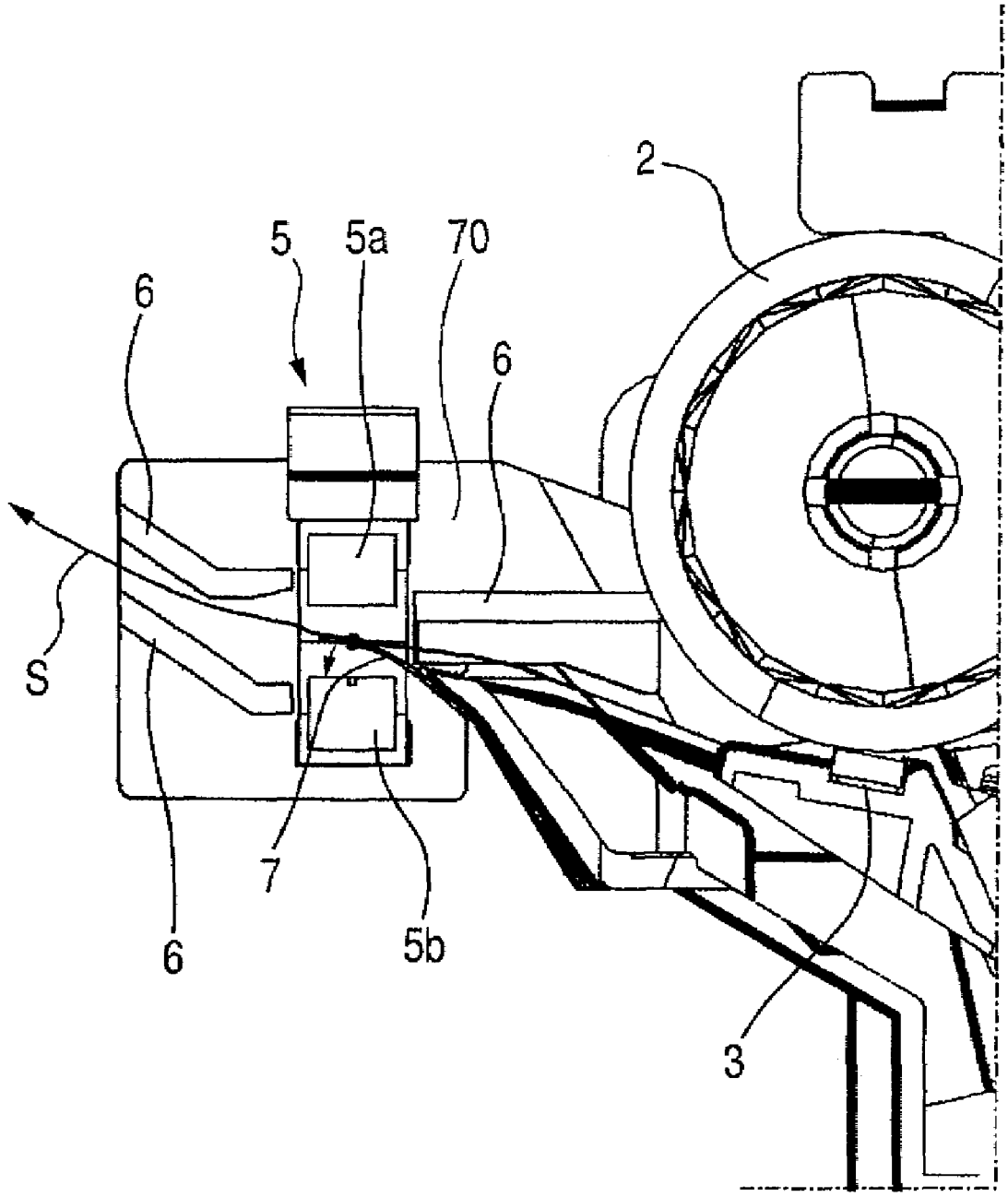
FIG. 8 is a constructional explanatory diagram of the sheet detecting sensor having the dust proofing member.

As illustrated in FIG. 8, when the sheet S is fed to the sheet detecting sensor 5, the sheet member 7 is pressed and bent by the sheet S and the sensor surface of the photosensing portion 5*b* is covered with the sheet member 7. Therefore, the paper powder or the like deposited to the sheet S is not dropped and adhered onto the sensor surface of the photosensing portion 5*b* and the erroneous detection of the sheet type can be prevented. Even if the paper powder or the like has been adhered onto the sheet member 7, when the sheet member 7 is pressed and bent by the sheet which is fed, the paper powder or the like is dropped out from the sheet member 7. Since the sheet member 7 is provided so as to cover the sensor surface of the photosensing portion 5*b*, the paper powder or the like dropped out from the sheet S is not dropped onto the sensor surface of the photosensing portion 5*b*.

In the image forming apparatus in any of the foregoing embodiments, the type of sheet S which is fed to the image forming portion is discriminated as mentioned above. The image is formed by the image forming portion based on a discrimination result. For example, if the fed sheet is an OHP sheet, even if the user selected the duplex recording, the recording mode is changed to the simplex recording and the image is recorded without executing the duplex recording. Thus, a wasteful execution of an image forming process can be prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-085120, filed Mar. 27, 2006, which is hereby incorporated by reference herein in its entirety.

What is claimed is:

1. A sheet feeding apparatus comprising:

a tray on which sheets to be fed are stacked;

a sheet feeding portion which separates and feeds the sheets stacked on the tray one by one;

a regulating member which is movable in a width direction which crosses a feeding direction of the sheet fed by the sheet feeding portion and regulates the sheets stacked on the tray in the width direction;

an extending portion which is provided on the regulating member and extends to downstream of the sheet feeding portion; and a sensor, which is provided on the extending portion, for discriminating a type of sheet, wherein in a state in which one sheet of the sheets stacked on the tray is protruded from the tray by the sheet feeding portion, the sensor discriminates the type of the protruded sheet.

2. An apparatus according to claim 1, wherein the sensor is a transmissive photosensor.

3. An apparatus according to claim 1, wherein the sensor has:

a light emitting portion which emits light; and a photosensing portion which receives the light that has been emitted by the light emitting portion and has transmitted the sheet fed by the sheet feeding portion, and the sensor is a sensor in which the light emitting portion and the photosensing portion are integrated.

4. An apparatus according to claim 3, further comprising:

a guiding portion, formed in the regulating member, which guides the sheet fed by the sheet feeding portion to a position between the light emitting portion and the photosensing portion.

5. An apparatus according to claim 1, further comprising a dust proofing member which prevents a foreign substance from being deposited onto a sensor surface of the sensor.

6. An image forming apparatus comprising:

a tray on which sheets to be fed are stacked;

a sheet feeding portion which separates and feeds the sheets stacked on the tray one by one;

an image forming portion which forms an image onto the sheet fed by the sheet feeding portion;

a regulating member which is movable in a width direction which crosses a feeding direction of the sheet fed by the sheet feeding portion and regulates the sheets stacked on the tray in the width direction;

an extending portion which is provided on the regulating member and extends to downstream of the sheet feeding portion; and a sensor, which is provided on the extending portion, for discriminating a type of the sheet.

7. An apparatus according to claim 6, wherein the image forming portion forms the image according to the sheet type determined based on an output of the sensor.

8. An apparatus according to claim 6, wherein the sensor is a transmissive photosensor.

9. An apparatus according to claim 6, wherein the sensor has:

a light emitting portion which emits light; and a photosensing portion which receives the light that has been emitted by the light emitting portion and has transmitted the sheet fed by the sheet feeding portion, and the sensor is a sensor in which the light emitting portion and the photosensing portion are integrated.

10. An apparatus according to claim 9, further comprising: a guiding portion, formed in the regulating member, which guides the sheet fed by the sheet feeding portion to a position between the light emitting portion and the photosensing portion.

11. An apparatus according to claim 6, further comprising a dust proofing member which prevents a foreign substance from being deposited onto a sensor surface of the sensor.

12. An apparatus according to claim 1, wherein in a state in which one sheet of the sheets stacked on the tray is protruded from the tray by the sheet feeding portion, the sensor emits light to the protruded sheet for discriminating the type of the protruded sheet.

13. An apparatus according to claim 6, wherein in a state in which one sheet of the sheets stacked on the tray is protruded from the tray by the sheet feeding portion, the sensor emits light to the protruded sheet for discriminating the type of the protruded sheet.

* * * * *